US009638049B2

(12) United States Patent
Dupeyre et al.

(10) Patent No.: US 9,638,049 B2
(45) Date of Patent: May 2, 2017

(54) TURBINE ENGINE BLADE

(71) Applicant: SNECMA, Paris (FR)

(72) Inventors: Raphael Dupeyre, Levallois-Perret (FR); Damien Alquier, Paris (FR); Sebastien Congratel, La Brosse Montceaux (FR); Guillaume Klein, Mery sur Oise (FR); David Mathieu, Chelles (FR); Ba-Phuc Tang, Cergy Saint Christophe (FR); Denis Gabriel Trahot, Herblay (FR)

(73) Assignee: SNECMA, Paris (FR)

( * ) Notice: Subject to any disclaimer, the term of this patent is extended or adjusted under 35 U.S.C. 154(b) by 453 days.

(21) Appl. No.: 14/228,409

(22) Filed: Mar. 28, 2014

(65) Prior Publication Data

US 2014/0294587 A1 Oct. 2, 2014

(30) Foreign Application Priority Data

Apr. 2, 2013 (FR) ..... 13 52967

(51) Int. Cl.
*F01D 5/30* (2006.01)
*F01D 11/00* (2006.01)
*F01D 5/14* (2006.01)

(52) U.S. Cl.
CPC ..... *F01D 5/30* (2013.01); *F01D 5/147* (2013.01); *F01D 5/3007* (2013.01); *F01D 11/006* (2013.01); *F01D 11/008* (2013.01)

(58) Field of Classification Search
CPC ..... F01D 5/30; F01D 11/006; F01D 5/147; F01D 5/3007; F01D 11/008
See application file for complete search history.

(56) References Cited

U.S. PATENT DOCUMENTS 8,047,797 B2 * 11/2011 Cosi ..... F01D 5/14 416/219 R
9,068,466 B2 * 6/2015 Stiehler et al. ..... F01D 5/16
2006/0013690 A1 1/2006 Athans et al.
(Continued)

FOREIGN PATENT DOCUMENTS

EP 1 617 044 A1 1/2006
EP 1 617 045 A1 1/2006

OTHER PUBLICATIONS

French Preliminary Search report issued Nov. 27, 2013 in French Application 13 52967, filed on Apr. 2, 2013 ( with English translation of Categories of Documents and Written Opinion).

*Primary Examiner* — Kevin Lee
(74) *Attorney, Agent, or Firm* — Oblon, McClelland, Maier & Neustadt, L.L.P.

(57) ABSTRACT

A turbine engine blade includes an airfoil connected by a platform to a middle radial wall extending axially and prolonged radially inwards by a blade root that is mountable in a slot of a disk, and the platform and the middle radial wall defining two lateral cavities situated on either side of the middle radial wall and opening out circumferentially to receive scaling members. The cavities are open downstream with two fins projecting on either side of the middle radial wall at downstream end of the middle radial wall, the fins coming to bear against two adjacent teeth of the disk between which the slot is formed. The downstream end of the middle radial wall includes a setback extending between at least one rib of the platform and the fins.

15 Claims, 3 Drawing Sheets

(56) References Cited

U.S. PATENT DOCUMENTS

| | | | | |
|---|---|---|---|---|
| 2006/0013691 | A1 | 1/2006 | Athans et al. | |
| 2012/0027605 | A1 | 2/2012 | Cordier et al. | |
| 2014/0083114 | A1* | 3/2014 | Beattie et al. | F01D 5/3007 60/806 |
| 2014/0356173 | A1* | 12/2014 | Evain et al. | F01D 5/10 416/193 A |

* cited by examiner

TURBINE ENGINE BLADE

BACKGROUND

1. Field of the Disclosure

The present invention relates to a turbine engine blade and to a turbine wheel, in particular a low pressure turbine wheel.

2. Description of the Related Art

A turbine wheel conventionally comprises a disk having its radially outer periphery formed with a series of teeth defining between them slots that are used for mounting blades.

Each blade has an airfoil connected by a platform to a middle radial wall extending axially and prolonged radially inwards by a blade root for mounting in a slot of the disk. The platform and said middle wall define two lateral cavities situated on either side of said middle wall and opening out circumferentially for receiving sealing members.

More particularly, the platform of each blade has a main wall in the form of a portion of a cylinder or a portion of a cone, which wall is extended upstream by an upstream radial rim that extends circumferentially, the rim itself being extended at its radially inner end by a lip extending upstream. A rib also extends downstream from the upstream rim, level with the upstream lip, said rib defining upstream bearing surfaces facing radially inwards and situated on either side of the middle wall.

Furthermore, the main wall of the platform forms a lip at its downstream end. A downstream rim extends circumferentially and radially inwards from a downstream zone of the main wall of the platform. The free end of the downstream rim forms downstream bearing surfaces facing radially inwards and situated on either side of the middle wall.

The main wall, the upstream and downstream rims, and the rib of the platform extend laterally on either side of the middle wall of the blade.

A lateral cavity is thus defined on either side of the middle wall by the main wall, by the upstream and downstream rims, by the rib, and by the middle wall.

In the assembled position, the platforms of the blades are arranged circumferentially in adjacent manner and they surround the teeth of the disk. The upstream and downstream bearing surfaces come to bear against the upstream and downstream ends of the corresponding adjacent teeth, with the root of each blade being spaced apart from the bottom of the corresponding slot.

The longitudinal ends of the platforms of the blades are spaced apart from one another in the circumferential direction by small amounts of clearance. Each above-mentioned sealing member is engaged in part in one of the lateral cavities of one blade and in part in the opposite lateral cavity of the directly adjacent blade.

In operation, the above-mentioned sealing members are urged radially outwards by centrifugal force and they come to bear radially against the inside faces of the platforms in order to limit leaks of gas between the longitudinal edges of the platforms. These members may also provide damping of the vibration to which the blades are subjected in operation.

Such a structure is disclosed in particular in Document FR 2 972 759 in the name of the Applicant, and it serves to hold the blades effectively in position in the slots while limiting leaks between the platforms of the blades. Nevertheless, that structure presents relatively great weight, which it would be appropriate to reduce in order to improve the performance of the turbine engine.

BRIEF SUMMARY

A particular object of the invention is to provide a solution to that problem, which is simple, effective, and inexpensive.

To this end, the invention provides a turbine engine blade comprising an airfoil connected by a platform to a middle radial wall extending axially and prolonged radially inwards by a blade root for mounting in a slot of a disk, the platform and said middle wall defining two lateral cavities situated on either side of said middle wall and opening out circumferentially for the purpose of receiving sealing members, the blade being characterized in that said cavities are open downstream with two fins projecting on either side of said middle wall at its downstream end, said fins coming to bear against two adjacent teeth of the disk between which the slot is formed, and in that the downstream end of the middle wall includes a setback extending between said rib and the fins.

According to the invention, the downstream radial rim is omitted and the lateral cavities are open downstream. This enables the weight of the blade to be reduced significantly without impacting its mechanical characteristics or its aerodynamic performance.

The fins projecting on either side of the middle wall ensure that the blade is properly positioned on the disk by bearing against the corresponding adjacent teeth.

The setback also makes a significant saving in weight possible. The presence of such a setback also makes it possible to limit the size of the plane surface of the downstream edge of the middle wall. This surface is usually subjected to truing machining. The invention thus makes it possible to reduce the cost and the time required for machining the blade.

Preferably, the ratio L/l of the length L of the setback in the blade, i.e. the maximum dimension of the setback in the longitudinal direction of the blade, divided by the width l of the setback, i.e. the maximum dimension of the setback in the direction perpendicular to the longitudinal direction of the blade lies in the range 10 to 35, and preferably in the range 15 to 30.

Such a ratio of dimensions achieves a significant saving in terms of weight without excessively affecting the mechanical strength of the blade. Thus, for given mechanical strength, the saving in weight may be about 0.5 kilograms (kg) for a wheel with all of its blades.

According to a characteristic of the invention, the platform includes at least one radially inner upstream portion defining at least one upstream bearing surface facing radially inwards, at least one fin defining a downstream bearing surface facing radially inwards such that the line passing via said upstream and downstream bearing surfaces is substantially perpendicular to the middle axis of the blade.

In this way, it is easy to verify that the line or the plane passing via the upstream and downstream bearing surfaces is perpendicular to the middle axis of the blade, so as to guarantee that the blade is properly positioned on the disk.

According to another characteristic of the invention, the platform has a main wall in the form of a portion of a finger or a portion of a cone that is prolonged upstream by a radial rim extending circumferentially, the rim itself being prolonged by a lip extending upstream.

Under such circumstances, the platform may include at least one rib extending downstream from the radial rim level with the upstream lip, said rib having a radially inner surface defining said upstream bearing surface.

Such a rib serves in particular as a stiffener enabling the mechanical strength of the blade to be increased.

Furthermore, the main wall of the platform may be prolonged downstream by a lip extending downstream.

The platform may include at least one rib extending radially inwards from the main wall level with the fins.

As before, such a rib serves in particular to form a stiffener that increases the mechanical strength of the blade.

Preferably, the ends of the setback are rounded.

The invention also provides a turbine wheel for a turbine engine, the wheel comprising a disk having a radially outer periphery including a series of teeth defining between them slots, the wheel being characterized in that it includes at least one blade of the above-specified type, the root of the blade being engaged in one of the slots of the disk in such a manner that the fins of the blade are suitable for bearing radially inwards against the adjacent teeth of the disk, the root of the blade being spaced apart from the bottom of the corresponding slot.

BRIEF DESCRIPTION OF THE SEVERAL VIEWS OF THE DRAWINGS

The invention can be better understood and other details, characteristics, and advantages of the invention appear on reading the following description made by way of non-limiting example and with reference to the accompanying drawings, in which.

DETAILED DESCRIPTION

Figure 1:
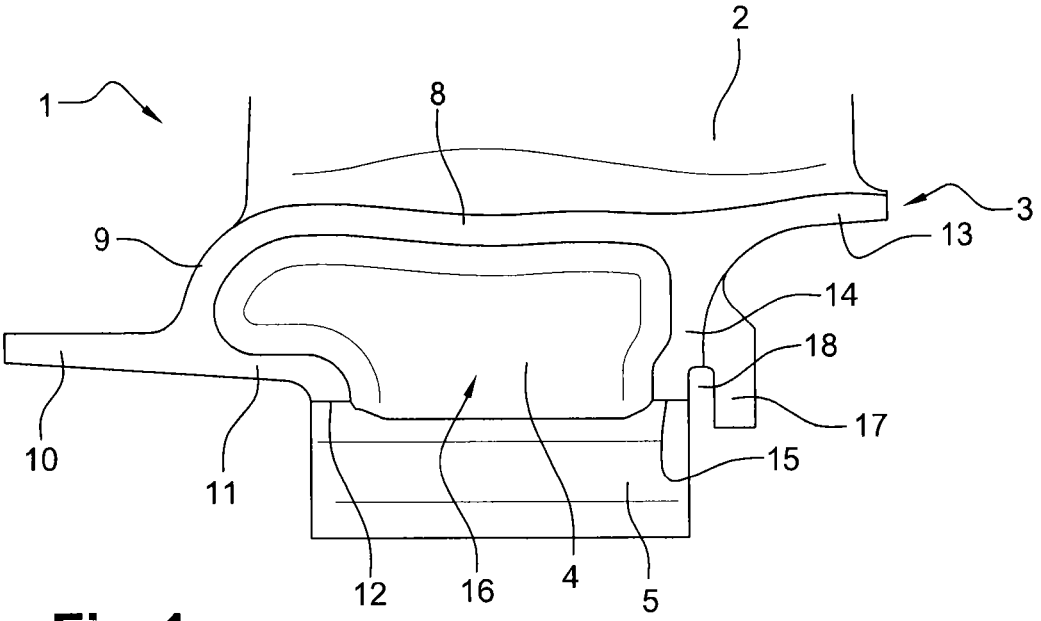
FIG. 1 is a side view of a portion of a prior art blade.
Figure 5:
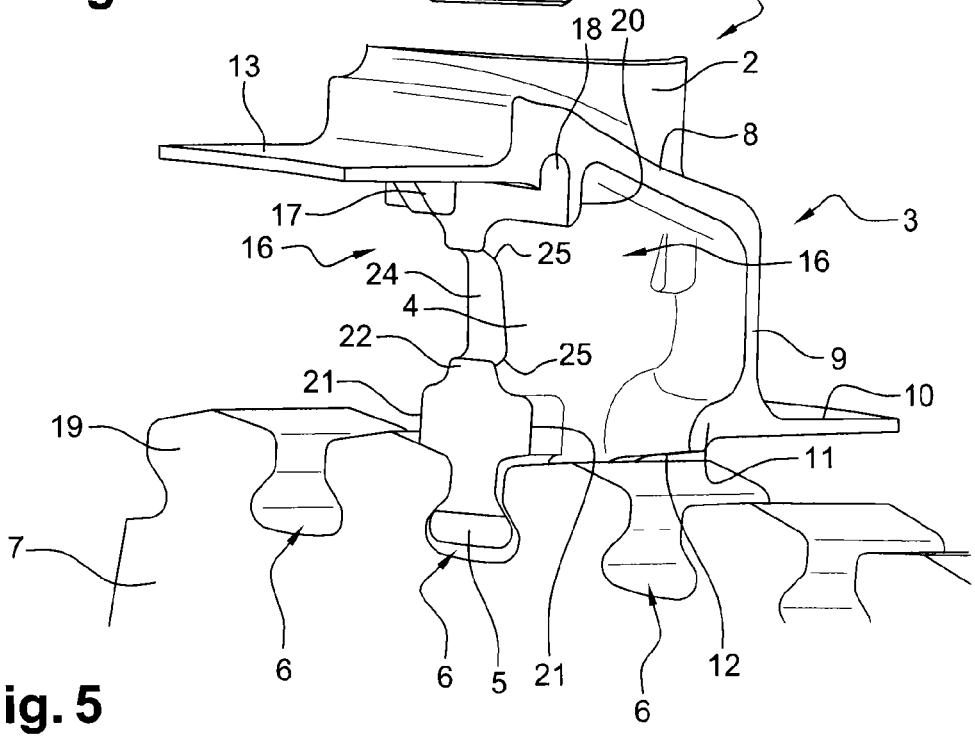
FIG. 5 is a view showing how a blade is mounted in a disk of a turbine wheel of the invention.

FIG. 1 shows a prior art rotary blade 1 of a low pressure turbine, the blade comprising an airfoil 2 connected by a platform 3 to a middle radial wall or tang 4 extending axially and prolonged radially inwards by means of a blade root 5 that is generally of dove-tail shape, for the purpose of being mounted in a slot 6 of complementary shape in a disk 7 (FIG. 5).

The platform 3 has a main wall 8 in the form of a portion of a cylinder, a portion of a cone, or a portion of a three-dimensional geometrical shape, that is prolonged upstream by an upstream rim 9 extending radially and circumferentially, itself prolonged by a lip 10 extending upstream. There is also a rib 11 extending downstream from the upstream rim 9 level with the upstream lip, said rib 11 defining two upstream bearing surfaces 12 facing radially inwards and situated on either side of the middle wall 4. The downstream portion of the main wall 8 forms a downstream lip 13.

A downstream rim 14 extends circumferentially and radially inwards from a downstream zone of the main wall 8 of the platform 3. The free end of the downstream rim 14 forms two downstream bearing surfaces 15 facing radially inwards and situated on either side of the middle wall 4.

The main wall 8, the upstream and downstream rims 9 and 14, and the rib 11 of the platform 3 extend laterally on either side of the middle wall 4 of the blade 1.

A lateral cavity 16 is thus defined on each side of the middle wall 4 by the main wall 8, by the upstream and downstream rims 9 and 14, by the rib 11, and by the middle wall 4.

As mentioned above, each cavity 16 is to receive a portion of a sealing member (not shown).

A finger 17 extends radially inwards from the middle wall 4 or the downstream rim 14. The finger 17 and the downstream rim 14 form a groove 18 opening out radially inwards and serving for insertion of a stop member enabling the blade 1 to be held in position on the disk 7, in known manner.

In the assembled position, the platform 3 of the blades 1 are arranged circumferentially in adjacent manner and they surround the teeth 19 of the disk 7 (FIG. 5). The upstream and downstream bearing surfaces 12 and 15 bear against the upstream and downstream ends of corresponding adjacent teeth 19 of the disk 7, the root 5 of the blade 1 being spaced apart from the bottom of the corresponding slot 6 of the disk 7.

The longitudinal edges of the platforms 3 of the blades 1 are separated from one another in the circumferential direction by small amounts of clearance. Each above-mentioned sealing member is engaged in part in one of the lateral cavities 16 of a blade 1 and in part in the opposite lateral cavity 16 of the immediately adjacent blade 1.

In operation, the above-mentioned sealing members are urged radially outwards by central force and they bear radially against the main walls 8 of the platforms 3 in order to limit leaks of gas between the longitudinal edges of the platforms 3. These members can also provide damping of the vibration to which the blades 1 are subjected in operation.

Such a structure is disclosed, in particular in Document FR 2 972 759 in the name of the Applicant, and it serves effectively to keep the blades 1 in position in the slot 6 and to limit leaks between the platforms 3 of the blades 1. Nevertheless, that structure presents relatively great weight, which it is desirable to reduce in order to improve the performance of the turbine engine.

The invention remedies that drawback by proposing a lighter blade 1, as shown in FIGS. 2 to 6.

The blade 1 does not have a downstream radial rim 14 extending over the entire length of the middle wall 4.

As before, it comprises an airfoil 2 connected by a platform 3 to a middle radial wall 4 extending axially and prolonged radially inwards in the form of a blade root 5 of generally dove-tailed shape for mounting in a slot 6 of complementary shape in the disk 7 (FIG. 5).

As before, the platform 3 has a main wall 8 in the form of a portion of a cylinder or a portion of a cone, and it is prolonged upstream by an upstream radial rim 9 extending circumferentially, itself prolonged by a lip 10 extending upstream. Furthermore, a rib 11 extends downstream from the radial rim 9 level with the upstream lip 10, said rib 11 defining two upstream bearing surfaces 12 facing radially inwards and situated on either side of the middle wall 4.

The downstream end of the main wall 8 is prolonged by a lip 13 extending downstream. A rib 20 also extends radially inwards from a downstream zone of the main wall 8. A radial groove 18 opening out radially inwards is formed between the rib 20 and a finger 17 extending radially inwards from the downstream lip 13. As above, this rib 18 serves for insertion of a stop member enabling the blade 1 to be held in position on the disk 7.

According to the invention, two ribs 21 project on either side of said middle wall 4 at its downstream edge 22, said fins 21 being for bearing against two adjacent teeth 19 of the disk 7 between which the slot 6 is formed that is used for mounting the root 5 of the blade 1.

Figure 3:
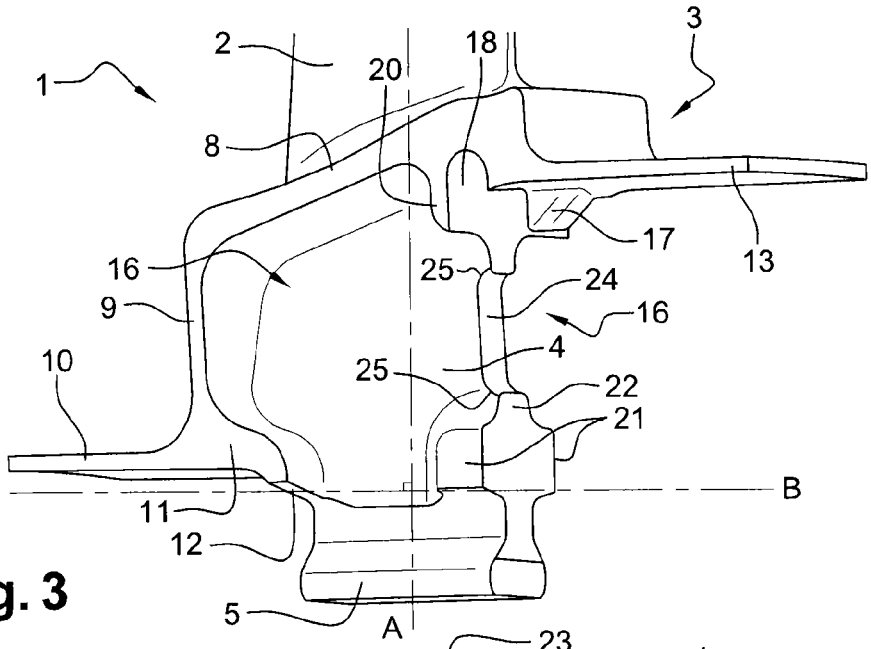
FIG. 3 is a perspective view of a portion of the blade of the invention.
Figure 4:
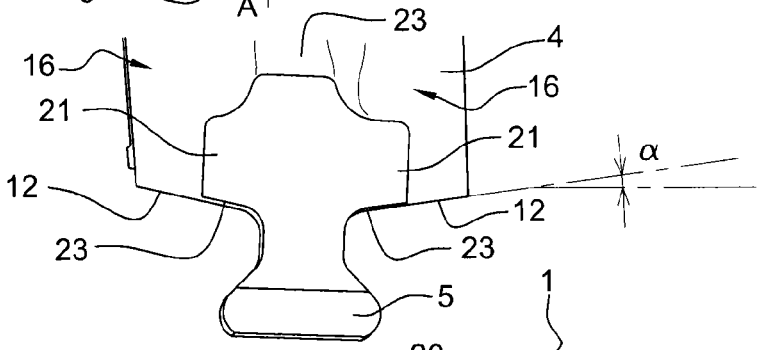
FIG. 4 is a rear view, i.e. from downstream, showing in detail the shape and the position of the fins of the blade of the invention.

The radially inner surfaces of the fins 21 form downstream bearing surfaces 23 (FIG. 4). The lines B passing via said upstream and downstream bearing surfaces are substantially perpendicular to the middle axis A of the blade (FIG. 3).

The downstream edge 22 of the middle wall 4 may also have a setback 24 extending between the rib 20 and the fins 21 so as to reduce the weight of the blade 1.

The setback 24 has a length L (defined by the maximum dimension of the setback 24 in the longitudinal direction of the blade) that lies in the range 14 millimeters (mm) to 20 mm, and a width l (defined by the maximum dimensions of the setback 24 in the longitudinal direction of the root, perpendicular to the longitudinal direction of the airfoil), lying in the range 0.7 mm to 1 mm. More generally, the ratio L/l of the length L divided by the width l lies in the range 10 to 34, and preferably in the range 15 to 30.

Figure 2:
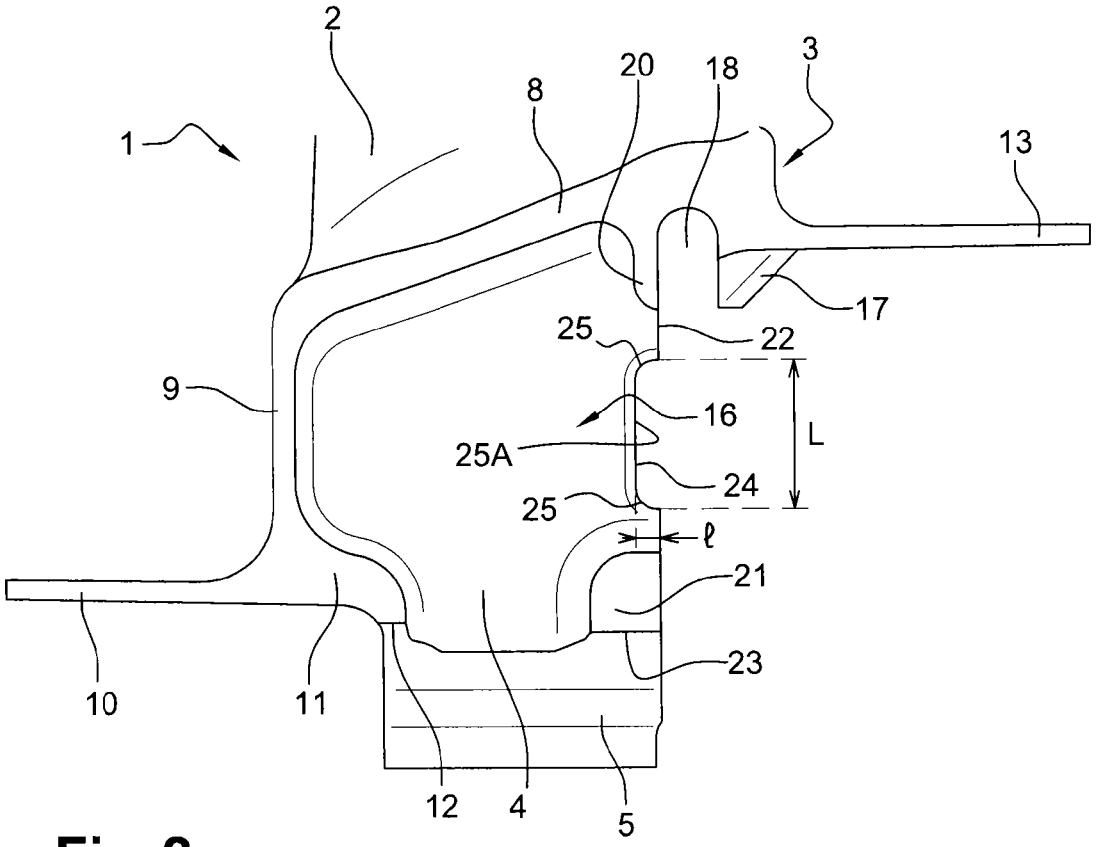
FIG. 2 is a view corresponding to FIG. 1 showing a blade of the invention.

The ends 25 of the setback 24 are rounded so as to limit the effects of mechanical stress concentration and so as to avoid cracks appearing. The rounded ends 25 define between them a substantially flat end wall 25A (FIG. 2). The radii of curvature of said ends 25 may for example lie in the range 0.9 mm to 1.1 mm, and are preferably about 1 mm.

As mentioned above, such a setback 24 serves to reduce the weight of the blade, while complying with specifications in terms of mechanical stresses.

As can be seen in FIG. 5, after the root 5 of the blade 1 has been inserted in the corresponding slot 6 of the disk 7, the blade 1 is positioned on the disk 7 with the upstream and downstream bearing surfaces 12 and 23 bearing against the corresponding teeth 19 of the disk 7. Also in this position, the root 5 of the blade 1 is held spaced apart from the bottom of the corresponding slot 6, so as to avoid any degradation of the bottom of the slot in the disk 7 or of the root 5 of the blade 1.

The angles of inclination and the shapes of the upstream and downstream bearing surfaces 12 and 23 are functions of the angles and the shapes of the surfaces of the teeth 19 of the disk 7.

In the example shown in FIGS. 2 to 6, the upstream and downstream bearing surfaces 12 and 23 are inclined relative to a plane perpendicular to the middle wall at an angle $\alpha$ lying in the range 0 to 15° (FIG. 4).

Figure 6:
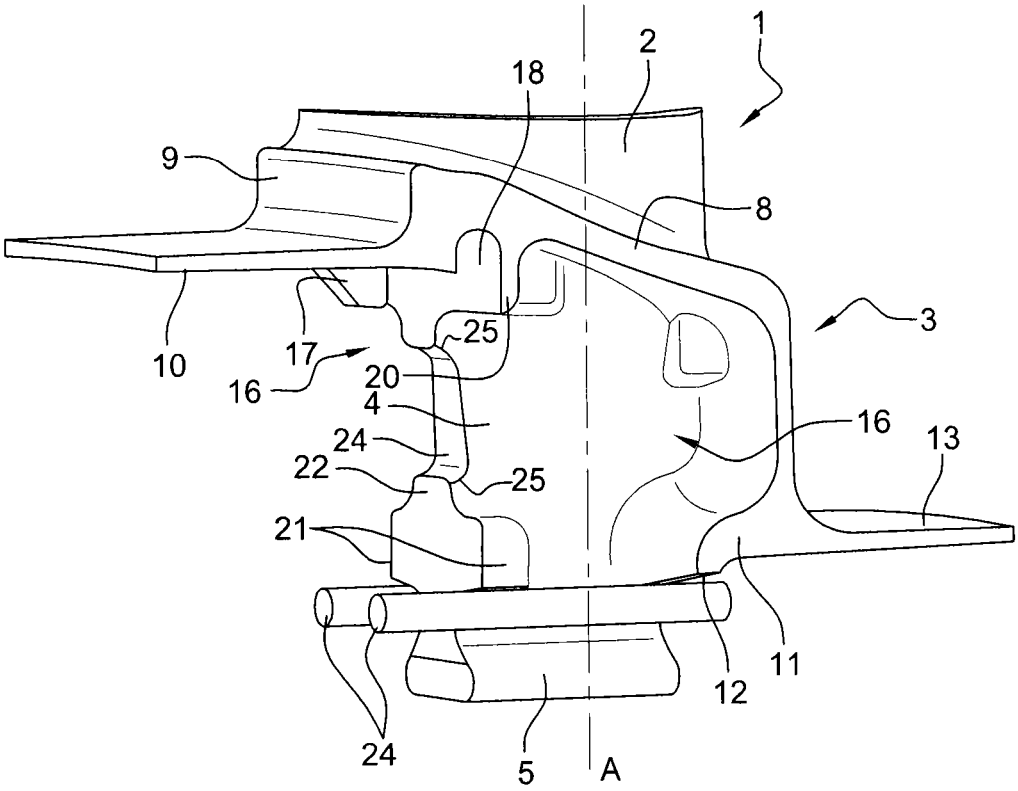
FIG. 6 is a perspective view showing diagrammatically a step of inspecting the shape of the blade of the invention.

The upstream and downstream bearing surfaces 12 and 23 also make it possible to verify the shape of the blade 1. For this purpose, and as shown in FIG. 6, two rods 24 are placed on either side of the root 5 of the blade 1 so that each rod 24 bears against the corresponding upstream and downstream bearing surfaces 12 and 23, and then it is verified whether the angle formed by each rod relative to the middle axis A of the blade is substantially equal to 90°. Such verification serves to guarantee that the blade 1 is properly positioned on the disk 7, and thus that the turbine engine operates properly.

The invention claimed is:

1. A turbine engine blade comprising:

an airfoil connected by a platform to a middle radial wall extending axially and prolonged radially inwards by a blade root that is mountable in a slot of a disk, and the platform and said middle radial wall defining two lateral cavities situated on either side of said middle radial wall and opening out circumferentially to receive sealing members, wherein said cavities are open downstream with two fins projecting on either side of said middle radial wall at a downstream end of said middle radial wall, said fins coming to bear against two adjacent teeth of the disk between which the slot is formed, and wherein the downstream end of the middle radial wall includes a setback extending between at least one rib of the platform and the fins.

2. The blade according to claim 1, wherein a ratio L/l of a length L of the setback, wherein L is a maximum dimension of the setback in a longitudinal direction of the airfoil, divided by a width l of the setback, wherein l is a maximum dimension of the setback in a longitudinal direction of the root of the blade, lies in a range of 10 to 35.

3. The blade according to claim 1, wherein the platform includes at least one radially inner upstream portion defining at least one upstream bearing surface facing radially inwards, at least one of the fins defining a downstream bearing surface facing radially inwards such that a line passing via said upstream and downstream bearing surfaces is substantially perpendicular to a middle axis of the blade.

4. The blade according to claim 1, wherein the platform has a main wall in the form of a portion of a finger or a portion of a cone that is extended upstream by a radial rim extending circumferentially, the rim being extended by a lip extending upstream.

5. The blade according to claim 4, wherein the at least one rib extends downstream from the radial rim level with the upstream lip, said at least one rib including a radially inner surface defining said upstream bearing surface.

6. The blade according to claim 3, wherein a main wall of the platform is extended downstream by a lip extending downstream.

7. The blade according to claim 3, wherein the at least one rib extends radially inwards from a main wall of the platform level with the fins.

8. The blade according to claim 1, wherein ends of the setback are rounded.

9. The blade according to claim 2, wherein the maximum dimension of the setback in the longitudinal direction of the airfoil lies in a range of 14 mm to 20 mm, and the maximum dimension of the setback in the longitudinal direction of the root of the blade lies in a range of 0.7 mm to 1 mm.

10. The blade according to claim 1, wherein a ratio L/l of a length L of the setback, wherein L is a maximum dimension of the setback in a longitudinal direction of the airfoil, divided by a width l of the setback, wherein l is a maximum dimension of the setback in a longitudinal direction of the root of the blade, lies in a range of 15 to 30.

11. The blade according to claim 10, wherein the maximum dimension of the setback in the longitudinal direction of the airfoil lies in a range of 14 mm to 20 mm, and the maximum dimension of the setback in the longitudinal direction of the root of the blade lies in a range of 0.7 mm to 1 mm.

12. The blade according to claim 3, wherein the upstream and downstream bearing surfaces are inclined relative to a plane perpendicular to the middle radial wall.

13. The blade according to claim 3, wherein the upstream and downstream bearing surfaces are disposed relative to a plane perpendicular to the middle radial wall at an angle that lies in a range of 0 to 15°.

14. The blade according to claim 8, wherein a radius of curvature of the ends lies in a range of 0.9 mm to 1.1 mm.

15. A turbine wheel for a turbine engine, the wheel comprising:

at least one of the blade according to claim 1, and the disk, which includes a radially outer periphery including a series of teeth defining slots of the disk between the teeth, the root of the blade being engaged in the slot that is one of the slots of the disk in such a manner that the fins of the blade are bearable radially inwards against the two adjacent teeth of the disk, the root of the blade being spaced apart from a bottom of the slot.

* * * * *